US007874722B2

(12) United States Patent
Clarkson et al.

(10) Patent No.: US 7,874,722 B2
(45) Date of Patent: Jan. 25, 2011

(54) WATCH CASING INTEGRALLY FORMED WITH WATCH BAND

(75) Inventors: Brad N. Clarkson, Beaverton, OR (US); Bo Stefan Andren, Portland, OR (US)

(73) Assignee: Nike, Inc., Beaverton, OR (US)

( * ) Notice: Subject to any disclaimer, the term of this patent is extended or adjusted under 35 U.S.C. 154(b) by 110 days.

(21) Appl. No.: 11/725,154

(22) Filed: Mar. 15, 2007

(65) Prior Publication Data

US 2008/0049560 A1 Feb. 28, 2008

Related U.S. Application Data

(63) Continuation-in-part of application No. 11/511,090, filed on Aug. 27, 2006.

(51) Int. Cl.
*A44C 5/00* (2006.01)

(52) U.S. Cl. ..... 368/281

(58) Field of Classification Search ..... 368/281, 368/261, 295, 282, 276, 88
See application file for complete search history.

(56) References Cited

U.S. PATENT DOCUMENTS

| | | | | |
|---|---|---|---|---|
| 2,472,351 | A * | 6/1949 | Tyler | 368/282 |
| 3,675,414 | A | 7/1972 | Cachelin | |
| 4,178,751 | A * | 12/1979 | Liautaud | 368/281 |
| 4,194,351 | A | 3/1980 | Kume et al. | |
| 4,229,936 | A * | 10/1980 | Schneider et al. | 368/282 |
| 4,462,697 | A | 7/1984 | Thompson | |
| 4,638,409 | A * | 1/1987 | Berman | 362/104 |
| 4,704,037 | A * | 11/1987 | Kroner | 368/203 |
| 4,708,492 | A | 11/1987 | Mock et al. | |
| 4,727,524 | A * | 2/1988 | Shoji et al. | 368/281 |
| 4,897,826 | A | 1/1990 | Rigberg et al. | |
| 4,958,279 | A | 9/1990 | Proellochs | |
| 5,010,532 | A | 4/1991 | Perrot | |
| 5,500,837 | A * | 3/1996 | Flury | 368/276 |
| 5,899,370 | A | 5/1999 | Bould | |
| 6,224,254 | B1 * | 5/2001 | Hayek et al. | 368/281 |
| 6,238,083 | B1 * | 5/2001 | Hirano et al. | 368/282 |
| 6,556,222 | B1 | 4/2003 | Narayanaswami | |
| D474,984 | S * | 5/2003 | Wilson | D10/37 |
| 6,619,836 | B1 | 9/2003 | Silvant et al. | |
| 6,728,166 | B2 | 4/2004 | Grupp | |

(Continued)

FOREIGN PATENT DOCUMENTS

| | | |
|---|---|---|
| EP | 0383180 | 8/1990 |

(Continued)

OTHER PUBLICATIONS

PCT/US2008/056491, International Search Report, dated Feb. 26, 2009.

(Continued)

*Primary Examiner*—Edwin A. Leon
(74) *Attorney, Agent, or Firm*—Banner & Witcoff, Ltd.

(57) ABSTRACT

A watch band construction in which the watch band itself forms at least a part of a watch casing. The watch band includes an integral casing portion that forms at least a part of a casing assembly for the watch. The casing portion of the watch band can then be securely affixed to a mating casing portion using any desired fastening technique.

20 Claims, 8 Drawing Sheets

U.S. PATENT DOCUMENTS

| | | | | |
|---|---|---|---|---|
| 6,766,182 | B2 | 7/2004 | Jannick et al. | |
| 6,775,206 | B2 | 8/2004 | Karhu | |
| 6,796,708 | B2 | 9/2004 | Kawamata et al. | |
| 6,857,775 | B1 * | 2/2005 | Wilson | 368/281 |
| 6,968,508 | B2 | 11/2005 | Lucaci et al. | |
| 6,971,789 | B2 | 12/2005 | Nakamura | |
| 7,114,845 | B2 | 10/2006 | Wilson | |
| 2001/0004397 | A1 | 6/2001 | Kita et al. | |
| 2002/0101457 | A1 | 8/2002 | Lang | |
| 2003/0043698 | A1 | 3/2003 | Guerry et al. | |
| 2003/0174589 | A1 | 9/2003 | Kawamata et al. | |
| 2007/0008824 | A1 | 1/2007 | Cretin | |

FOREIGN PATENT DOCUMENTS

| | | |
|---|---|---|
| EP | 0389441 | 9/1990 |
| JP | 52-036060 | 3/1977 |
| JP | 62-239081 | 10/1987 |
| WO | 2004012178 | 2/2004 |

OTHER PUBLICATIONS

PCT/US2008/056491, Written Opinion, dated Feb. 26, 2009.
International Search Report and Written Opinion in corresponding PCT Application No. PCT/US2007/016854, Mailed Mar. 13, 2008.
International Preliminary Report on Patentability for Application No. PCT/US2007/16854, Mailed Mar. 12, 2009.

* cited by examiner

WATCH CASING INTEGRALLY FORMED WITH WATCH BAND

RELATED APPLICATIONS

This application claims priority under 35 U.S.C. §120 to U.S. patent application Ser. No. 11/511,090 filed on Aug. 27, 2006, entitled "Rocking Bezel Control" and naming Alec Ishihara as inventor, which application is incorporated entirely herein by reference.

FIELD OF THE INVENTION

The present invention relates to the attachment of a watch band to a watch. Various examples of the invention may be particularly applicable to a watch band that forms at least part of the casing for a watch.

BACKGROUND OF THE INVENTION

The watch industry is continuously seeking to improve the durability of watch bands. Originally, watch bands were formed from leather or fabric. While these materials were relatively flexible and comfortable, bands made from these materials were not very durable. Exposure to water and continuous wear, for example, will quickly degrade leather and fabric watch bands. To address these deficiencies, some watch makers have created watch bands out of metal links. While metal link watch bands are more resilient than leather and fabric watch bands, they are relatively heavy and expensive.

Recently, inexpensive and rugged watches have become popular, particularly for various sporting activities such as running, boating, diving, and climbing. In order to keep the cost of these watches low while still providing an environmentally-resistant band, some watch makers have begun using watch bands formed from plastic or rubber. These bands conventionally will have an attachment portion on each end that defines some type of a springbar passage for receiving a springbar. As known in the art, a springbar has a hollow cylinder containing two pins at either end. The pins are forced outward by a spring within the cylinder. The watch, in turn, will have two extensions or "lugs" that extend from each side of the watch (i.e., the watch will have a pair of opposing lugs on either side). Usually, these lugs are integrally formed with the watch casing. Also, each lug defines a pin recess facing a corresponding pin recess on the opposite lug.

To attach the band to a watch, a springbar is inserted into the springbar passage of an attachment portion at one end of the band, and the pins are pressed into the hollow cylinder. With the pins thus compressed, the attachment portion of the band is inserted between two opposing lugs of a watch casing. When the attachment portion is positioned so that the springbar is aligned between the lug recesses, the spring in the springbar forces the pins into the lug recesses to secure the attachment portion between the lugs. This process is then repeated with the attachment portion on the other end of the watch band and the remaining pair of opposing lugs.

While this configuration allows a watch band to be quickly replaced, the entire strength of the attachment is based upon the springbar. If enough force is placed on the band or watch to bend the springbar or to compress even one of the pins in the springbar, then the band will come away from the watch. Because conventional springbars are very thin (typically not more than a few millimeters in diameter), this type of separation is not an uncommon occurrence. Also, in many instances, the material of the band forming the springbar passage can rip or tear, causing the springbar to separate from the band. Still further, if the lugs are made of a material that is not durable, such as brittle plastic, then the lugs can fail causing the band to separate from the watch. Accordingly, watch makers are continuously seeking improved techniques and structures to attach a watch band to a watch.

BRIEF SUMMARY OF THE INVENTION

Various embodiments of the invention provide a watch band construction in which the watch band itself forms at least a part of a watch casing. With some implementations of the invention, the watch band includes a casing portion that forms at least a part of a casing assembly for the watch. The casing portion of the watch band can then be securely affixed to a mating casing portion using any desired fastening technique.

DETAILED DESCRIPTION OF THE INVENTION

Watch Construction

Figure 1:
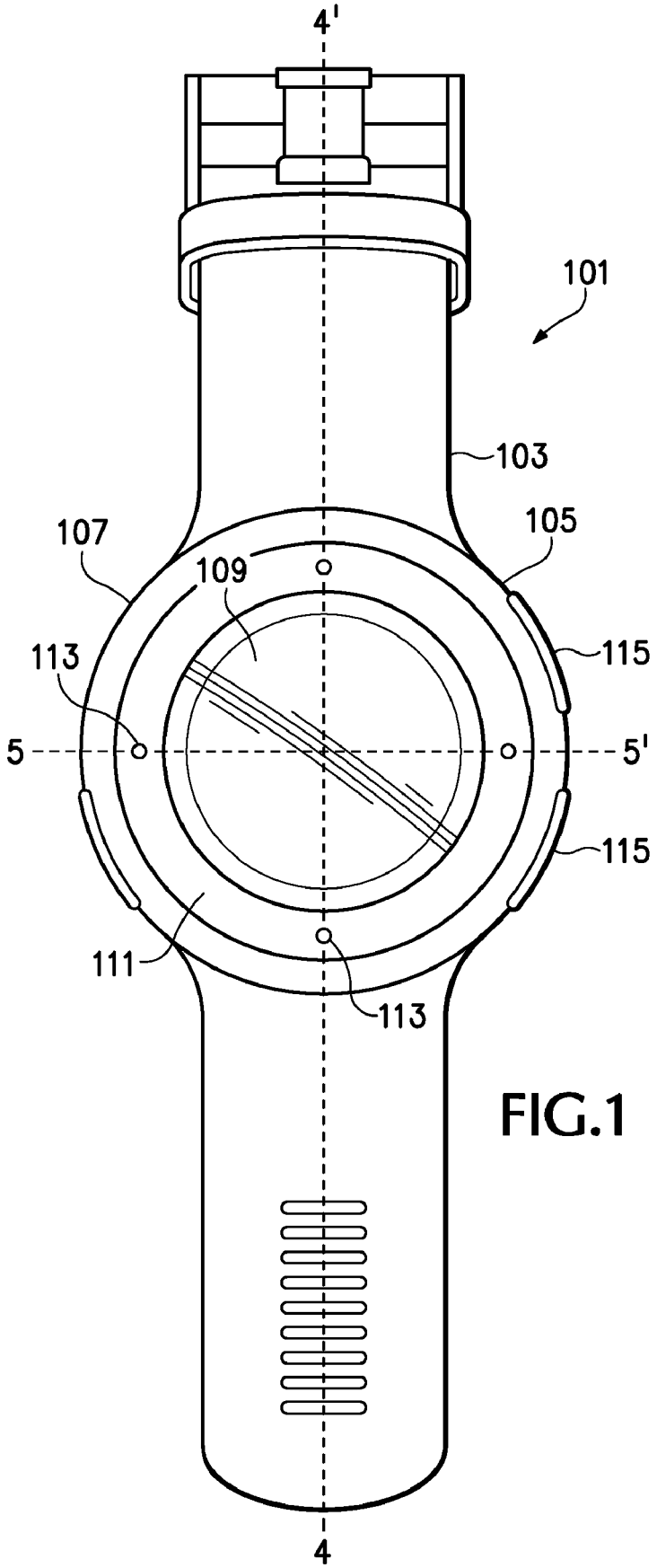
FIG. 1 is a top planar view of a wristwatch implementing a watch band construction according to various examples of the invention.
Figure 2:
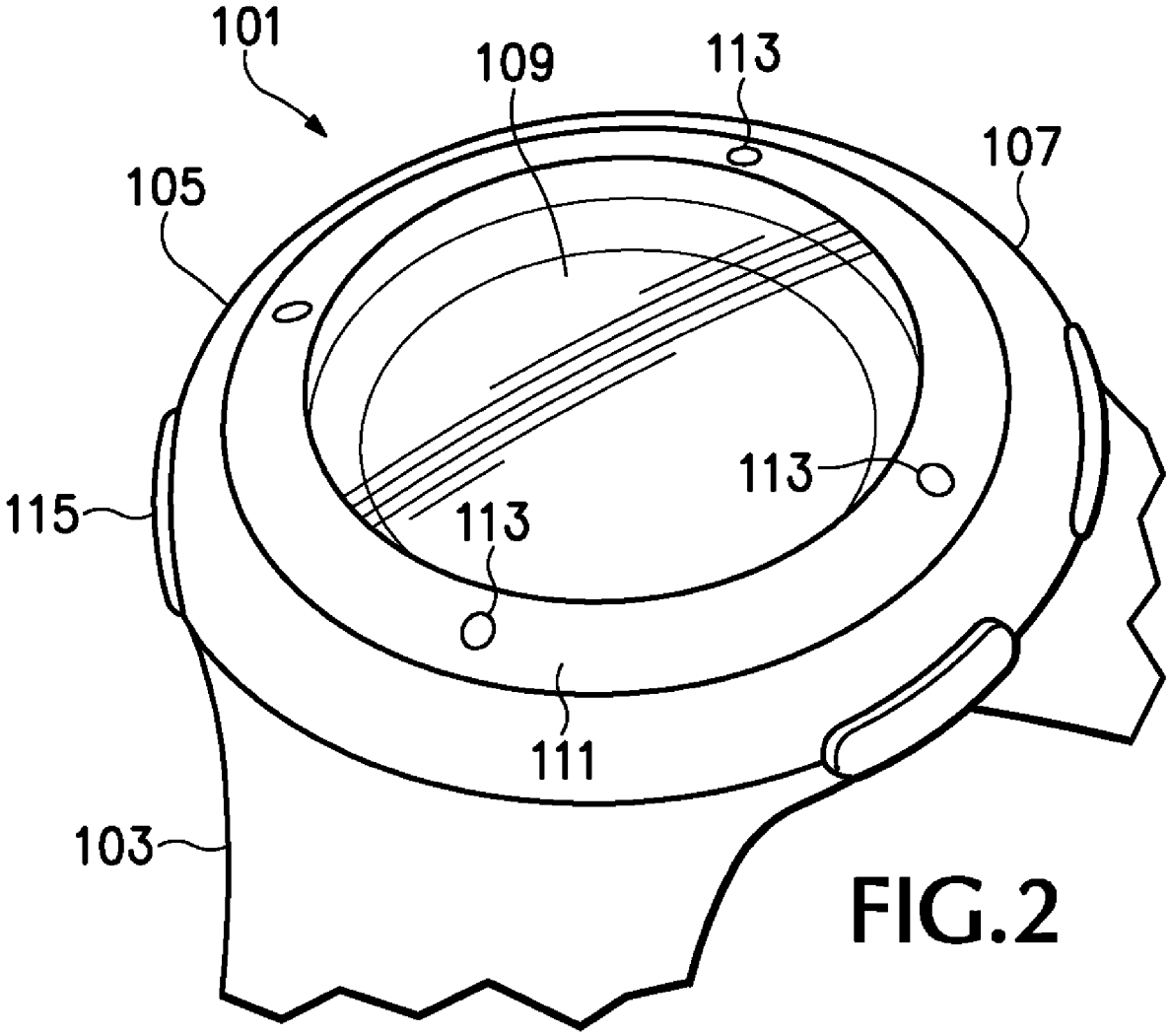
FIG. 2 is a perspective upper view of the wristwatch illustrated in FIG. 2.

FIGS. 1 and 2 illustrate an example of a portable electronic device 101. More particularly, these figures illustrate a portable electronic device implemented as a wristwatch 101, which includes a band 103 and a watch 105. The watch 105 may perform a variety of functions. For example, in addition to being a chronometer, the watch 105 may also function as a stopwatch, a timer, a compass, an altimeter, a digital music player, a thermometer, a barometer, a remote control for another electronic device (either portable or stationary), or some combination thereof.

With various implementations of invention, the band 103 may be formed of any desirable material, such as, for example, polyurethane, rubber, or some other combination of material or materials that form both a flexible band structure and a casing portion, as will be described in more detail below.

The watch 105 includes a casing 107 and a display module 109. The casing 107 encloses the electrical and/or mechanical components that implement the chronometer and other functions of the watch 105. The display module 109 then displays the output data produced by the functional components of the watch 105. As will be discussed in more detail below, the display module 109 may, for example, include a liquid crystal display (LCD), a light emitting diode (LED) display, an organic light emitting (OLE) display, one or more analog rotating hands or dials, or another type of display using any other desired technology.

The watch 105 also includes a bezel 111. Conventionally, the term "bezel" refers to the surface ring of a watch that surrounds the watch's crystal and holds the crystal in place. As used herein, however, the term bezel refers to any ring which separates at least the upper portion of a display module for an electronic device from the upper portion of a casing for the electronic device. With various examples of the invention, the bezel may have a circular, elliptical, polygonal or irregular shape. Further, the bezel may be independent from the display module of the electronic device, and serve no function with respect to holding a lens or cover for the display module in position.

With the watch 105 illustrated in FIGS. 1 and 2, the bezel 111 separates the upper portion of the display module 109 from the upper portion of the casing 107. As will be discussed in more detail below, however, the bezel 111 is independent from the display module 109. The bezel 111 includes a plurality of bezel control indicators 113. Each of these bezel control indicators 113 marks a location where the bezel 111 can be depressed to control some operation of the watch 105. The bezel control indicators 113 may be graphical marks printed on or engraved into the bezel 111, raised areas on the surface of the bezel 111, depressions in the surface of the bezel 111, or any combination thereof.

In addition to the bezel 111, the watch 105 may optionally include one or more control buttons 115 for controlling one or more operations of the watch 105. In the illustrated example, the control buttons 115 are positioned along the side of the casing 107. With other examples of the invention, however, the control buttons 115 may alternately or additionally be positioned on the upper portion of the casing 107, or even extend through an aperture in the bezel 111. Of course, with some examples of the invention, the control buttons 115 may be omitted altogether.

Figure 3:
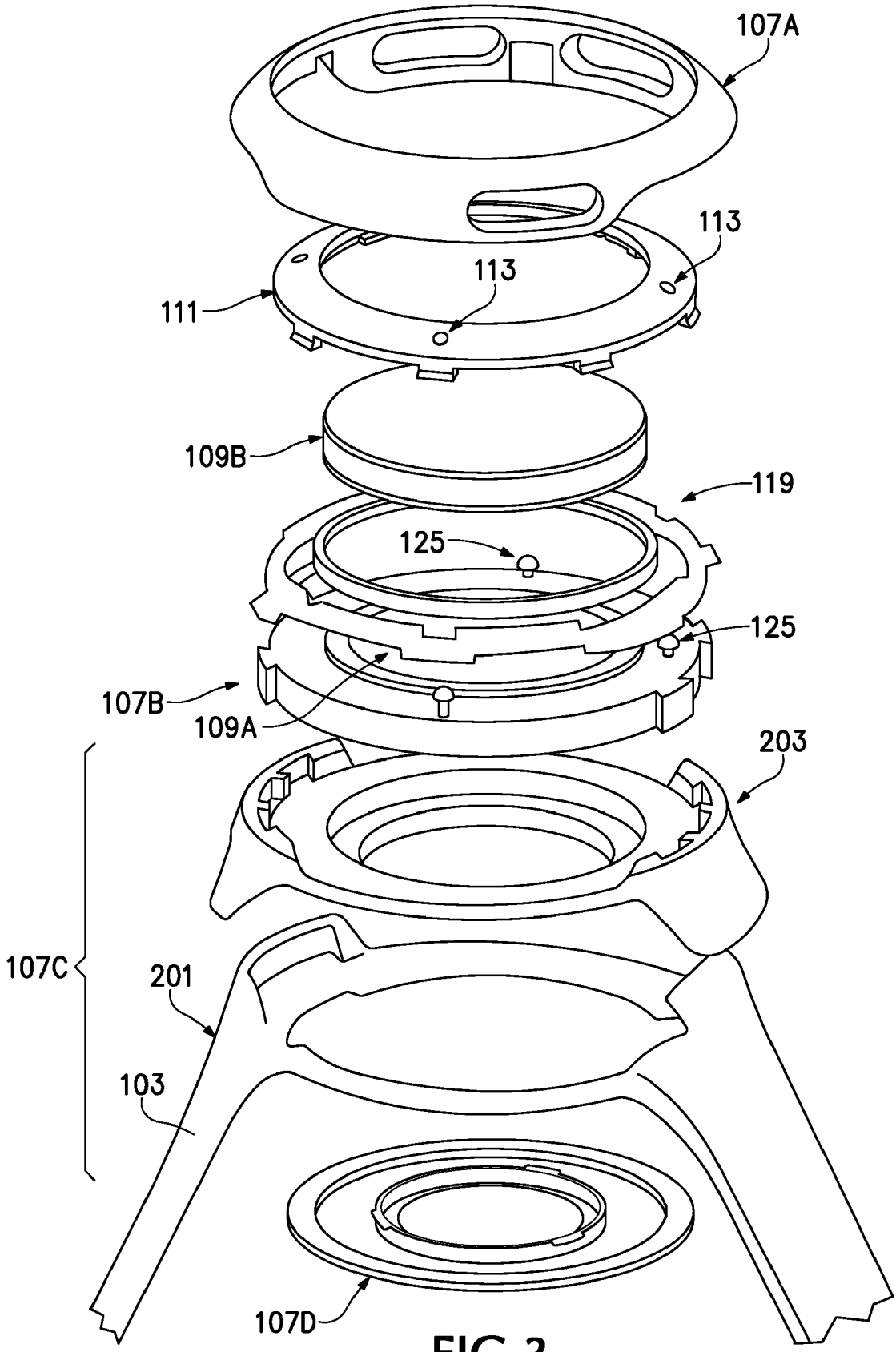
FIGS. 3 and 4 are exploded perspective views of the wristwatch illustrated in FIGS. 1 and 2.
Figure 4:
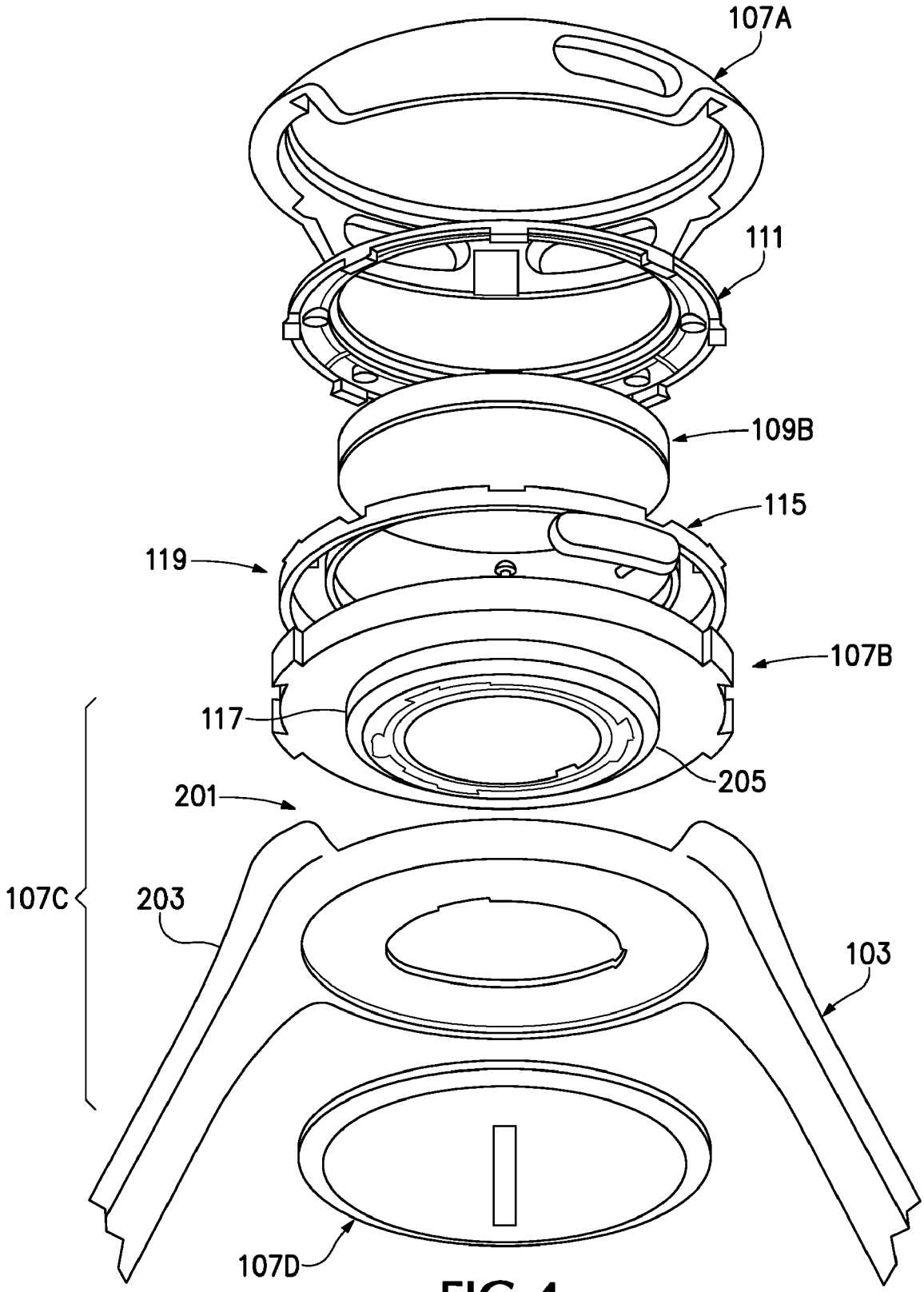
Figure 5:
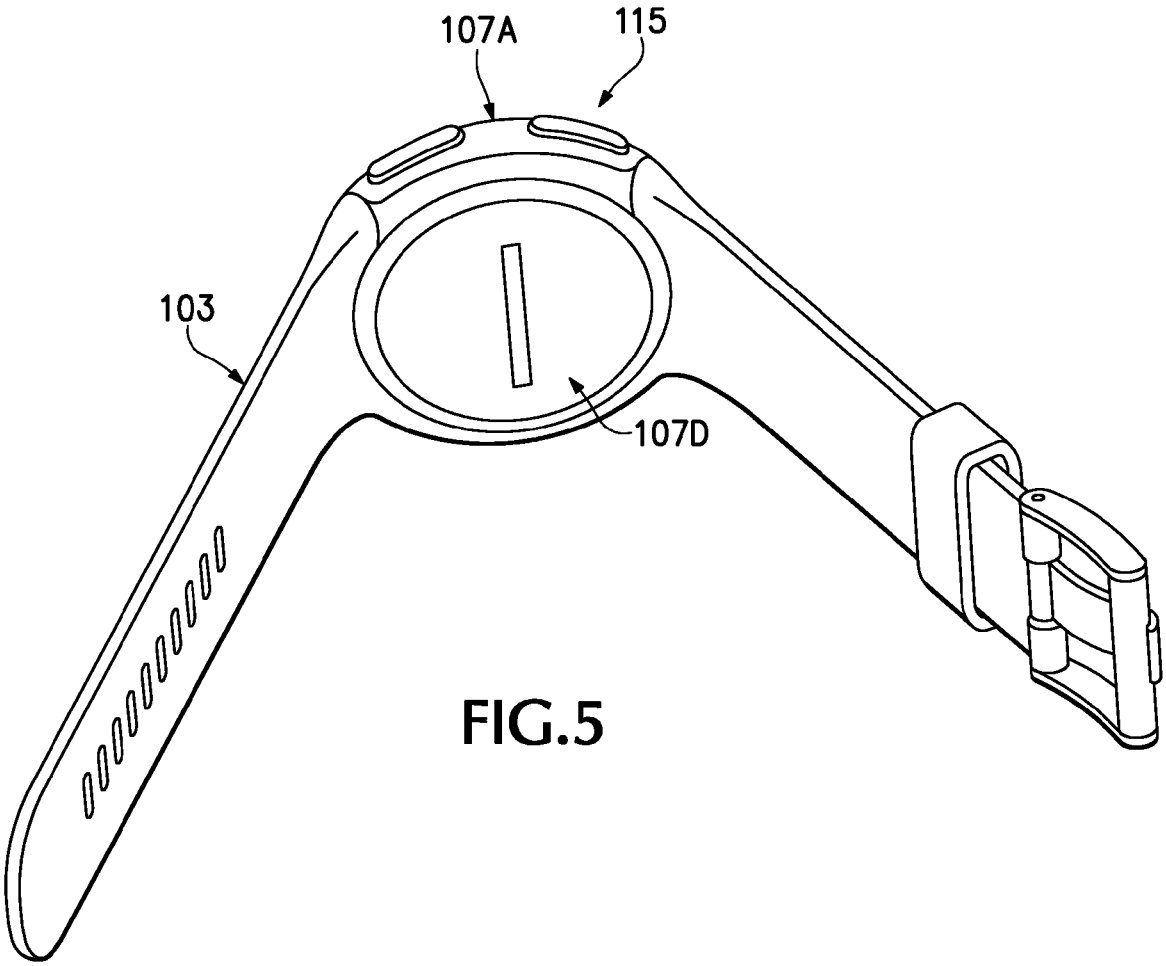
FIG. 5 is a perspective bottom view of the wristwatch illustrated in FIGS. 1-4.
Figure 6:
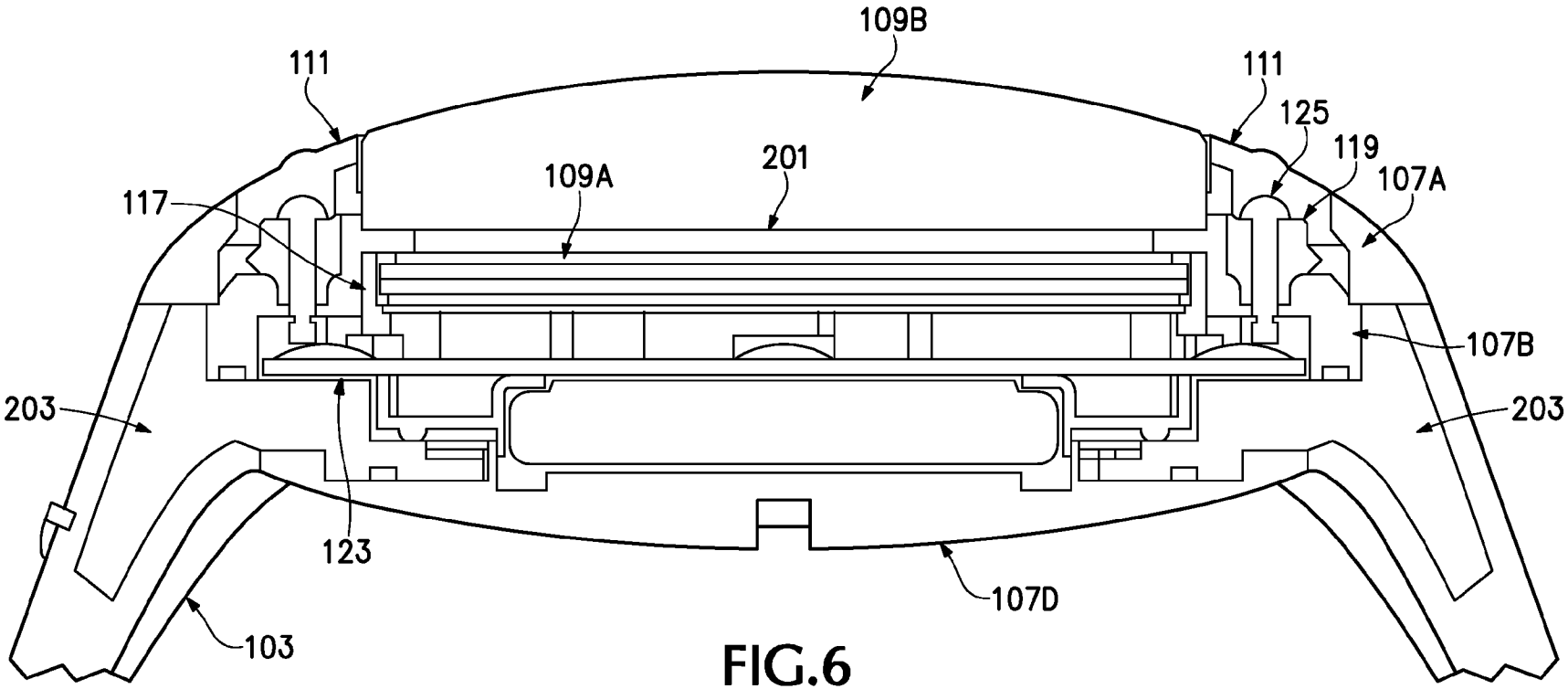
FIG. 6 is a cross-sectional view along lines 4-4' in FIG. 1.
Figure 7:
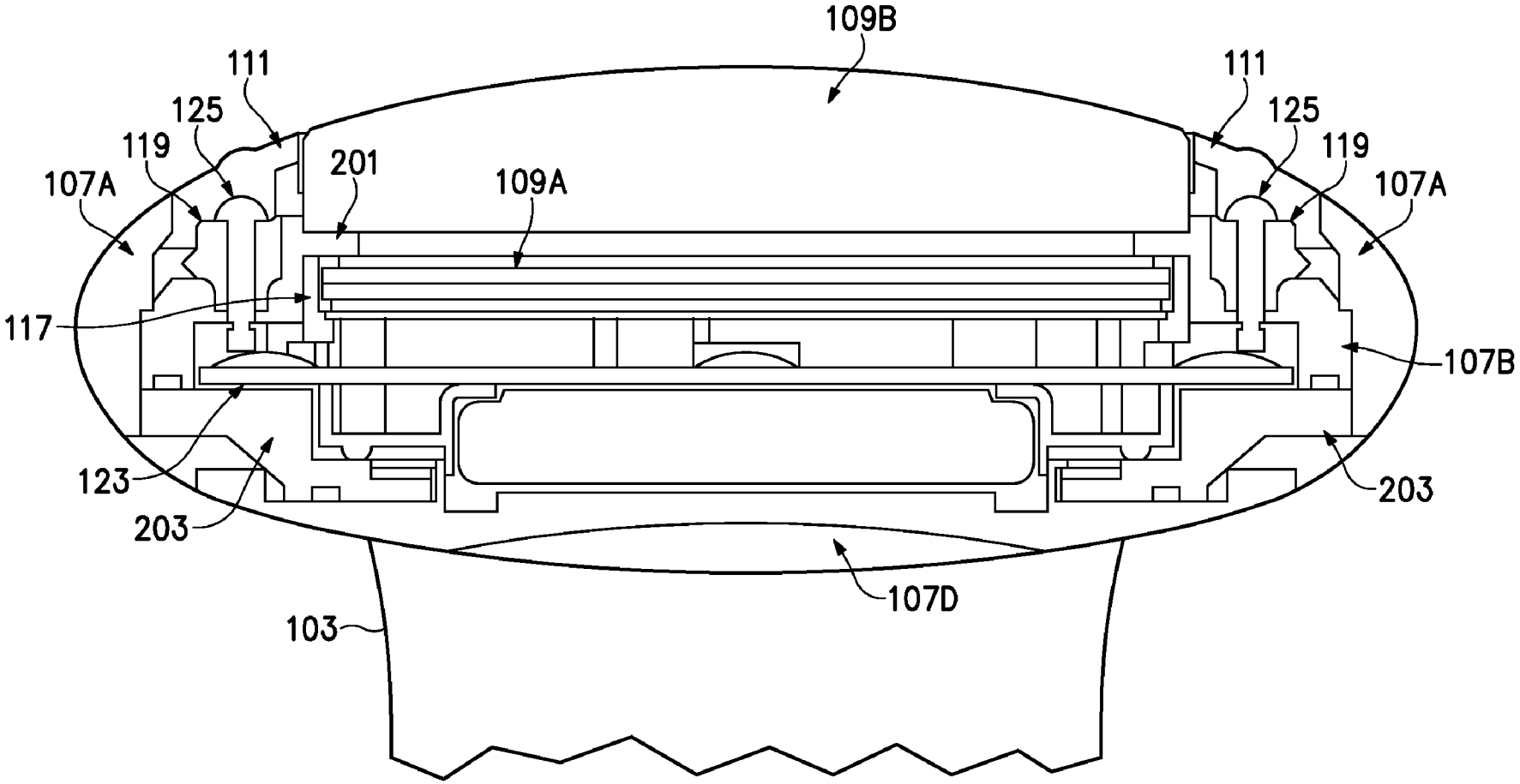
FIG. 7 is a cross-sectional view along lines 5-5' in FIG. 1.
Figure 9:
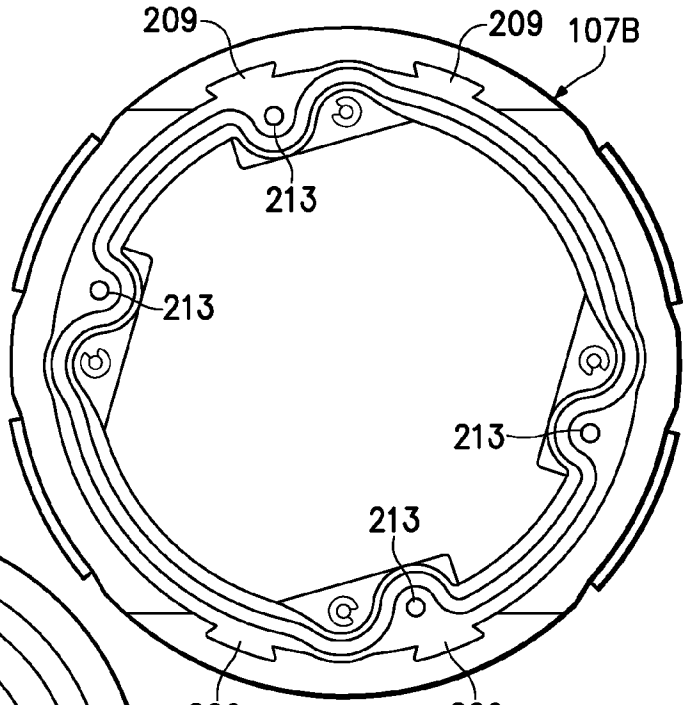
FIG. 9 is a bottom planar view of an upper lower casing portion according to various examples of the invention.

Turning now to FIGS. 3 and 4, these figures illustrate exploded perspective views of the components of the wristwatch 101 illustrated in FIGS. 1 and 2. Also, FIG. 5 is a perspective bottom view of the wristwatch illustrated in FIGS. 1-4, while FIG. 6 is a cross-sectional view along lines 4-4' in FIG. 1, and FIG. 7 is a cross-sectional view along lines 5-5' in FIG. 1.

As seen in this figure, the watch casing 107 includes a casing cover 107A, an upper casing portion 107B, a lower casing assembly 107C, and a battery hatch cover 107D. As will be discussed in more detail below, the lower casing assembly 107C includes a band portion 201 integrally formed with the watch band 103, a watch module support 203, and a battery hatch locking plate 205. In this manner, a portion of the watch band 103 is incorporated into the watch casing 107.

The lower casing assembly 107C supports a watch module assembly 117, which in turn supports a spring mount 119. Together, the upper casing portion 107B, the lower casing assembly 107, the battery hatch cover 107D and a lens 109B encase the watch module assembly, to protect from dust, dirt, moisture, and other environmental hazards. As seen in FIG. 3, a spring 119 is mounted on the upper casing portion 107B. The spring 119 itself may then be co-molded to match the bottom surface of the bezel 111. With various examples of the invention, the spring 119 is formed of a resilient material, which can be compressed but which will have a tendency to return to its original shape.

For example, the spring 219 may be formed of a polyurethane or rubber. As will be discussed in greater detail below, forming the spring 219 of sufficiently resilient material will pressure the bezel 111 to maintain its primary plane at a constant position relative to the primary plane of the watch 105. With the watch 105 illustrated in FIGS. 1-3, the primary plane of the bezel 111 is substantially parallel to the primary plane of the watch 105. When a user presses down on a portion of the bezel 111 to rock it, the user thus will feel some resistance provided by the resiliency of the spring 219. Further, when the user stops pressing down on that portion of the bezel 111, the resiliency of the spring 219 will force the bezel 111 back to its original position (i.e., with the primary plane of the bezel 111 parallel to the primary plane of the watch 105).

As previously noted, the bezel 111 may be rocked, potentially exposing the watch module assembly 117 to debris and moisture. Accordingly, the spring 219 may additionally act as a barrier to prevent debris and moisture from collecting underneath the bezel 111 is rocked. As will be appreciated by those of ordinary skill in the art, forming the spring 219 of a resilient material will improve the ability of the spring 119 to block debris and moisture from reaching underneath the bezel 111.

The functional components of the watch 105 are contained within the watch module assembly 117. With various examples of the invention, one or more functions of the watch 105 are implemented by electronic circuitry. For example, the watch 105 may provide a chronometer function, a stopwatch function, a timer function, an altimeter function, a digital music player function, a thermometer function, a barometer function, or a remote control function for another electronic device using a microprocessor, a memory circuit, and one or more electronic sensors. Similarly, if the watch 105 implements one or more functions (e.g., a chronometer, stopwatch, or timer function) using mechanical components, then these mechanical components may be housed within the watch module assembly 117 as well.

Accordingly, the watch module assembly 117 will include one or more input devices 123 for controlling the operation of electronic circuitry housed within the watch module assembly 117. With some examples of the invention, the input devices 123 will be simple switches (i.e., electronic devices that have only an on or off state). For example, the input devices 123 illustrated in FIG. 3 are dome switches. With this type of switch, two separated electrodes are positioned beneath a dome of deformable material. The inner surface of the dome then is formed of a conductive material such that, when pressure is applied to deform the dome, the inner surface contacts both electrodes to complete an electric circuit. Of course, other examples of the invention alternately or additionally may use other types of input devices 123.

Depending upon the configuration of the electronic circuitry housed within the watch module assembly 117, the functions of the watch can be controlled by some designated actuation of the input devices 123. For example, an operation of the electronic circuitry can be initiated by actuating an input device 123, actuating multiple input devices 123 (either together or in a particular sequence), maintaining one or more input devices 123 in an "on" or "off" state for a preset amount of time, etc. A wide variety of techniques for controlling electronic circuitry using input devices is well known, and thus will not be discussed here in further detail.

In addition to the input devices 123, the watch module assembly 117 also includes a display 109A, which forms a component of the display module 109. As previously noted, the display 109A may be a liquid crystal display (LCD), a light emitting diode (LED) display, an organic light committing display, one or more conventional analog rotating hands, or a display implemented using any other desirable technology. The display module 109 also include a transparent lens 109B, such as a mineral lens (i.e., a crystal), which covers the display 109A to protect it from damage. In the illustrated example, the lens 109B is adhered to the top surface of the watch module assembly 117. With alternate examples of the invention, however, the lens 109B may be held in place by grooves formed in the bezel 111, and thus rock with the bezel 111.

The watch 105 also includes a plurality of pushers 125. As illustrated in FIG. 3, each pusher 125 extends from the bezel 111 toward an input device 123. More particularly, each pusher 125 is located between a portion of the bezel 111 with a bezel control indicator 113 and an input device 123. Accordingly, when a user depresses the bezel 111 at a position with a bezel control indicator 113, the resulting rocking movement of the bezel 111 will in turn move the pusher 125 located below the bezel control indicator 113 toward its corresponding input device 123. If the bezel 111 is depressed with sufficient force, the pusher 125 will push down against the input device 123 to actuate it.

It should be appreciated that structures other than the spring 219 may be used to resiliently support the bezel 111. For example, with some embodiments of the invention, different types of springs, such as leaf springs, coiled springs, or any other desired type of spring may alternately or additionally be used to resiliently support the bezel 111. The springs may be, for example, leaf springs positioned between the bezel 111 and the upper casing portion 107B or the watch module assembly 117, or between the pushers 125 and the lower casing assembly 107C or the watch module assembly 117. The springs also may be coil springs that, e.g., are wrapped around the pushers 125 or positioned between the bezel 111 and the upper casing portion 107B or the watch module assembly 117. Of course, still other structures can be used to resiliently support the bezel 111 while allowing portions of the bezel 111 to rock toward and back from the input devices 123.

Still further, it should be appreciated that various embodiments of the invention may include fewer or more input devices 123 than the four input devices 123 illustrated in the particular example of the invention shown in FIG. 1-5. For example, some embodiments of the invention may have five or more input devices 123 arranged around the circumference of the bezel 111. Also, while particular examples of the invention have been described with reference to a wristwatch 101, various embodiments of the invention may be employed with any portable electronic device having a display and one or more controls. For example, various embodiments of the invention can be employed with a hand-held digital music player, radio, CD player, wireless telephone or the like.

Band Construction

As previously noted, the lower casing assembly 107C for the watch 105 includes a band portion 201 integrally formed with the watch band 103, a watch module support 203, and a battery hatch locking plate 205. As seen in FIG. 3, the band portion 201 is sized to generally correspond to the size of the upper casing portion 107B. The band portion 201 defines an aperture for receiving a watch battery, as will be discussed in more detail below. The band portion 201 also defines a recess for receiving the watch module support 203.

Figure 8:
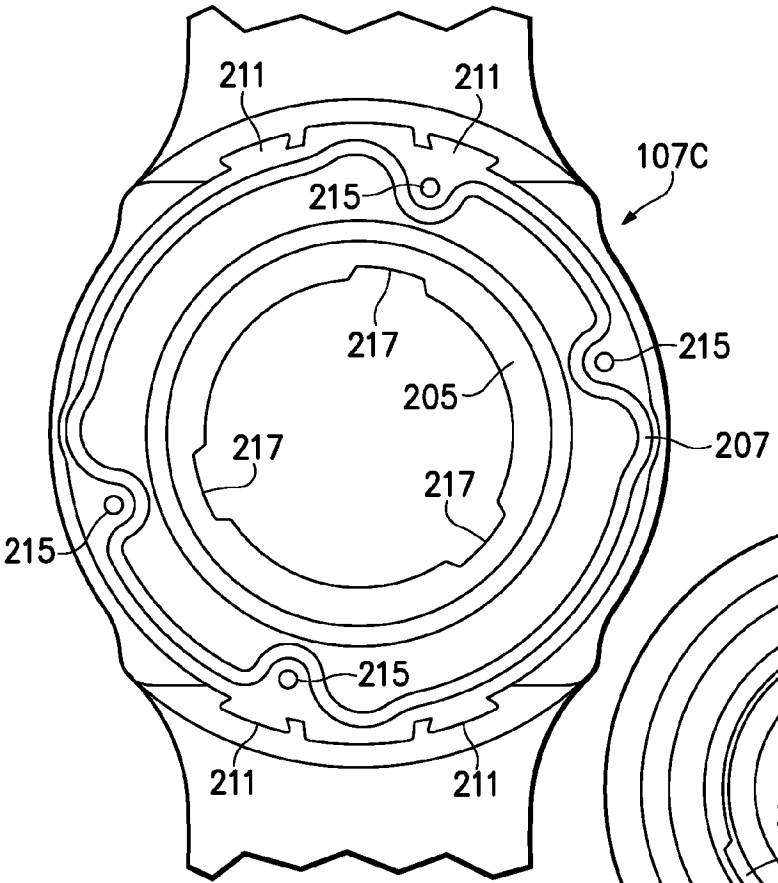
FIG. 8 is a top planar view of a lower casing assembly according to various examples of the invention.

The watch module support 203 sits inside of the recess formed in the band portion 201. The watch module support 203 defines a locking plate recess for receiving the battery hatch locking plate 205, and a watch module assembly recess for receiving at least a portion of the watch module assembly 117. With some examples of the invention, the watch module support 203 may additionally define a raised gasket structure 207 on the surface defining the watch module assembly recess, as shown in FIG. 8. The gasket structure 207 may be configured to press up against the perimeter of watch module assembly 117, to prevent moisture or debris from reaching the watch module assembly 117. It should be appreciated, however, that with alternate implementations of the invention, the band portion 201 may extend over some or all of the watch module support 203 so as to form a gasket for sealing against the upper casing portion 107B.

Figure 10:
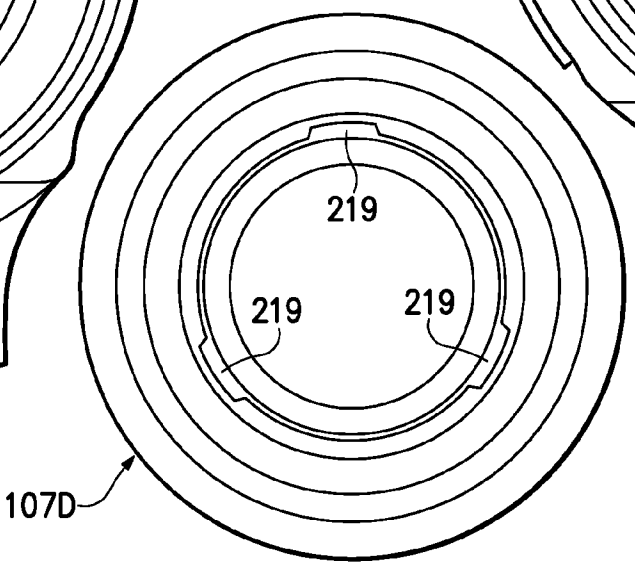
FIG. 10 is a top planar view of the battery hatch cover according to various examples of the invention.

The watch module support 203 also may include one or more fastening structures for assisting to secure the upper casing portion 107B to the lower casing assembly 107C. For example, the upper casing portion 107B may include one or more dovetail-shaped protrusions 209, as seen in FIG. 8, while the watch module support 203 may define a corresponding number of dovetail-shaped recesses 211, as seen if FIG. 10. When the upper casing portion 107B is placed onto the lower casing assembly 107C, the dovetail-shaped protrusions 209 of the upper casing portion 107B will fit into the dovetail-shaped recesses 211 of the watch module support 203, to prevent the upper casing portion 107B from rotating relative to the lower casing assembly 107C before the upper casing portion 107B can be more securely affixed to the lower casing assembly 107C. Further, the dovetail-shaped protrusions 209 and recesses 211 may be configured to prevent the upper casing portion 107B from being placed onto the lower casing assembly 107C in an improper orientation.

With some implementations of the invention, one or more threaded screw recesses 213 may be formed in the upper casing portion 107B facing the lower casing assembly 107C. A corresponding number of screw apertures 215 may then be defined in the band portion 201 and the watch module support 203. With this arrangement, screws can be extended through the screw apertures 215 in the band portion 201 and the watch module support 203 to the threaded screw recesses 213 in the upper casing portion 107B, to securely affix the upper casing portion 107B to the lower casing assembly 107C. Of course, alternate examples of the invention may employ any desired fastening mechanism or mechanisms to securely but removably affix the upper casing portion 107B to the lower casing assembly 107C.

Because the band portion 201 is integrally formed with the band 103, the band portion 201 may be formed of a very flexible or pliant material, such as rubber or a soft, flexible plastic material. In order to provide a rigid casing for supporting and protecting the watch module assembly 117, the watch module support 203 may then be formed of a rigid material, such as a hard plastic or metal. With various examples of the invention, the watch module support 203 may be secured to the band portion 201 using any desirable technique. For example, the watch module support 203 may be affixed to the band portion 201 using an adhesive, screws or rivets, or any other fastening device. In the illustrated example of the invention, the band portion 201 is co-molded to the watch module support 203. With some implementations of the invention, the band portion 201 and the watch module support 203 may even be formed of a single piece of material having a different rigidity for the band portion 201 and the watch module support 203.

As previously noted, the watch module support 203 defines a locking plate recess for receiving the battery hatch locking plate 205. The battery hatch locking plate 205 defines a battery aperture for receiving a watch battery. It also defines a plurality of connection recesses 217 around the perimeter of the battery aperture corresponding to connection flanges 219 on the battery hatch cover 107D, as shown in FIG. 8. The battery hatch locking plate 205 may be formed of a relatively hard material, such as metal or a hard plastic. As will be discussed in detail immediately below, the battery hatch locking plate 205 allows the battery hatch cover 107D to be securely attached to the watch module assembly 117.

The battery hatch cover 107D includes a connection piece with a plurality of connection flanges 219 corresponding to the connection recesses 217 on the battery hatch locking plate 205. After a battery has been inserted into a watch module assembly 117 through the battery apertures defined band portion 201, the watch module support 203, and the battery hatch locking plate 205, the connection piece of the battery hatch cover 107D is inserted through the battery apertures as well. More particularly, the connection piece of the battery hatch cover 107D is inserted through the battery apertures so that the connection flanges 219 of the battery hatch cover 107D pass through the connection recesses 217 in the battery hatch locking plate 205. The battery hatch cover 107D is then rotated, so that the connection piece of the battery hatch cover 107D is secured to the battery hatch locking plate 205 in a bayonet-type connection. In this manner, the battery hatch cover 107D can be removed to connect a battery to power the electronic circuitry housed in the watch module assembly 117. The battery hatch cover 107D can then be reattached to the hatch plate 211 to protect the battery and the watch module assembly 205 from debris and moisture.

It should be appreciated, however, that various embodiments of the invention can omit the battery hatch locking plate 205. With these alternate implementations of the invention, the battery hatch cover 209D may, for example, connect directly to the band portion 201. The band portion 201 may, e.g., have a connection recesses similar to the connection recesses 217 in the battery hatch locking plate 205 of the illustrated invention. The use of the option battery hatch locking plate 205 reduces wear on the material forming the band portion 201, which may be soft and flexible as noted above.

CONCLUSION

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A watch casing, comprising:

an upper casing portion; and a lower casing assembly, the lower casing assembly including a portion of a watch band, the portion of the watch band defining a recess configured to receive a watch module support; wherein the watch module support is positioned within the recess and includes a first portion extending along the recess and a second, angled portion extending substantially downward from the first portion and into the portion of the watch band such that a bottom edge of the second, angled portion is vertically below a bottom edge of the first portion.

2. The watch casing recited in claim 1, wherein the watch module support is co-molded to the watch band.

3. The watch casing recited in claim 1, wherein the watch module support is formed of a rigid material, and the portion of the watch band is formed of a flexible material.

4. The watch casing recited in claim 1, further comprising a battery hatch cover that removably attaches to the lower casing assembly.

5. The watch casing of claim 1, wherein the watch module support defines a recess configured to receive at least a portion of a watch module assembly.

6. The watch casing recited in claim 1, wherein the lower casing assembly further includes a battery hatch cover plate configured to removably attach to a battery hatch cover.

7. The watch casing recited in claim 6, further comprising a battery hatch cover that removably attaches to the battery hatch cover plate.

8. The watch casing recited in claim 1, wherein the lower casing assembly includes a gasket structure for forming a seal with the upper casing portion.

9. The watch casing recited in claim 8, wherein the gasket structure is integrally formed with the watch module support.

10. A method of assembling a watch casing, comprising:

receiving, in a recess in a watch band portion, a watch module support, the watch module support having a first portion extending along the recess and a second, angled portion extending substantially downward from the first portion and into the watch band portion such that a bottom edge of the second, angled portion is vertically below a bottom edge of the first portion;

forming a lower casing assembly including the watch band portion and the watch module support; and attaching the lower casing assembly to an upper casing portion to form a watch case.

11. The method recited in claim 10, further comprising interposing a watch module between the lower casing assembly and the upper casing portion before attaching the lower casing assembly to the upper casing portion.

12. The method recited in claim 10, further comprising attaching the watch module support to the watch band portion by co-molding the watch module support to the watch band portion.

13. The method recited in claim 10, wherein the watch module support is formed of a rigid material, and the watch band portion is formed of a flexible material.

14. The method recited in claim 10, further comprising removably attaching a battery hatch cover to the lower casing assembly.

15. The method of claim 10, wherein the watch module support defines a recess for receiving at least a portion of a watch module.

16. A watch casing, comprising:

an upper casing portion;

a lower casing assembly, connected to the upper casing portion, the lower casing assembly including a portion of a watch band, the portion of the watch band formed of a first material and including a recess;

a watch module support positioned within the recess of the portion of the watch band having a first portion extending along the recess and a second, angled portion extending substantially downward from the first portion and into the portion of the watch band such that a bottom edge of the second, angled portion is vertically below a bottom edge of the first portion, the watch module support being formed of a second material, the second material being different from the first material.

17. The watch casing of claim 16, wherein the second material is a rigid material.

18. The watch casing of claim 16, wherein the first material is a flexible material.

19. The watch casing of claim 16, further including a watch module arranged between the upper casing and the lower casing assembly.

20. The watch casing of claim 16, wherein the watch module support defines a recess for receiving at least a portion of a watch module.

* * * * *